US010012011B2

(12) United States Patent
Choi et al.

(10) Patent No.: US 10,012,011 B2
(45) Date of Patent: Jul. 3, 2018

(54) DEVICE FOR SEALING CONTAINER DOOR AND METHOD FOR OPERATING SAME

(71) Applicant: S-WINNUS Co., Ltd., Busan (KR)

(72) Inventors: Hyungrim Choi, Busan (KR); Jaejoong Kim, Busan (KR); Jaekee Lee, Busan (KR); Soongoo Hong, Busan (KR); Chaesoo Kim, Busan (KR); Gwanghoon Kwark, Busan (KR); Gangbae Lee, Busan (KR); Eunkyu Lee, Busan (KR); Jungrock Son, Busan (KR); Sungpill Choi, Busan (KR); Youngsik Moon, Busan (KR); Joongjo Shin, Busan (KR); Jinwook Lee, Busan (KR); Heemok Son, Busan (KR); Woocheol Choi, Busan (KR); Yoonji Kim, Gyeongsangnam-do (KR); Junwoo Jung, Busan (KR); Minjung Kim, Busan (KR); Minho Kim, Busan (KR); Hansoo Park, Busan (KR); Jaeseong Oh, Busan (KR)

(73) Assignee: S-WINNUS Co., Ltd., Busan (KR)

( * ) Notice: Subject to any disclaimer, the term of this patent is extended or adjusted under 35 U.S.C. 154(b) by 210 days.

(21) Appl. No.: 14/917,954

(22) PCT Filed: Sep. 24, 2013

(86) PCT No.: PCT/KR2013/008532
§ 371 (c)(1),
(2) Date: Mar. 10, 2016

(87) PCT Pub. No.: WO2015/037770
PCT Pub. Date: Mar. 19, 2015

(65) Prior Publication Data

US 2016/0215533 A1 Jul. 28, 2016

(30) Foreign Application Priority Data

Sep. 11, 2013 (KR) ..... 10-2013-0109015

(51) Int. Cl.
*G08B 13/14* (2006.01)
*E05B 83/14* (2014.01)
(Continued)

(52) U.S. Cl.
CPC ..... *E05B 83/14* (2013.01); *B65D 90/008* (2013.01); *B65D 90/22* (2013.01); *G07C 9/00182* (2013.01)

(58) Field of Classification Search
CPC ..... B65D 90/008; B65D 90/22; E05B 83/14; G07C 9/00182
USPC ..... 340/572.9
See application file for complete search history.

(56) References Cited

U.S. PATENT DOCUMENTS 4,416,075 A * 11/1983 Bauer ..... A23G 3/50 40/546
5,934,116 A * 8/1999 Moore ..... E05B 67/383 292/218

(Continued)

FOREIGN PATENT DOCUMENTS

JP 2007-309057 11/2007
KR 10-0904591 6/2009

(Continued)

OTHER PUBLICATIONS

International Search Report dated May 26, 2014 From the Korean Intellectual Property Office Re. Application No. PCT/KR2013/008532 and Its Translation Into English.

*Primary Examiner* — Naomi J Small

(57) ABSTRACT

A device for sealing a container door are configured for the sake of a container security in such a way that the device for sealing a container door is installed at a locking device of a (Continued)

container door so as to detect if the container door is forcibly opened or closed by an unauthorized person during a container transportation from a freight-loaded place to a freight-unloaded place, and a result of such a detection is wirelessly transmitted to a container security system. The device for sealing a container door includes a main body, a locking member, a fixing unit, a stopper unit, a seal-release authentication unit, a holding unit, a seal-sensing unit, a LED state display unit, a battery, and a control board.

24 Claims, 9 Drawing Sheets

(51) Int. Cl.

| | |
|---|---|
| ***B65D 90/22*** | (2006.01) |
| ***B65D 90/00*** | (2006.01) |
| ***G07C 9/00*** | (2006.01) |

(56) References Cited

U.S. PATENT DOCUMENTS

| | | | | |
|---|---|---|---|---|
| 6,564,600 | B1 * | 5/2003 | Davis | E05B 47/0669 70/277 |
| 7,229,107 | B2 | 6/2007 | Kuckertz | |
| 8,066,142 | B2 | 11/2011 | Yin et al. | |
| 2006/0081019 | A1 | 4/2006 | Kuckertz | |
| 2008/0252084 | A1 | 10/2008 | Francis et al. | |
| 2010/0201519 | A1 * | 8/2010 | Dagher | B65D 90/022 340/561 |
| 2010/0283580 | A1 * | 11/2010 | Sheng | B65D 90/22 340/5.31 |
| 2012/0001757 | A1 * | 1/2012 | Jung | E05B 13/002 340/542 |
| 2012/0021619 | A1 * | 1/2012 | Bilbrey | H01R 13/6205 439/39 |
| 2012/0248790 | A1 * | 10/2012 | Costabel | E05B 15/004 292/96 |
| 2013/0015950 | A1 * | 1/2013 | Wip | E05B 47/00 340/5.54 |
| 2013/0224539 | A1 * | 8/2013 | Hayashi | H01M 2/1055 429/82 |
| 2014/0245798 | A1 * | 9/2014 | Beckman | E05B 19/00 70/14 |
| 2016/0052709 | A1 * | 2/2016 | Kochanowski | B65D 88/524 403/363 |

FOREIGN PATENT DOCUMENTS

| | | |
|---|---|---|
| KR | 10-1175173 | 8/2012 |
| WO | WO 2015/037770 | 3/2015 |

* cited by examiner

Cross section taken along line A-A

Cross section taken along line B-B

Cross section taken along line C-C

[Fig. 10]
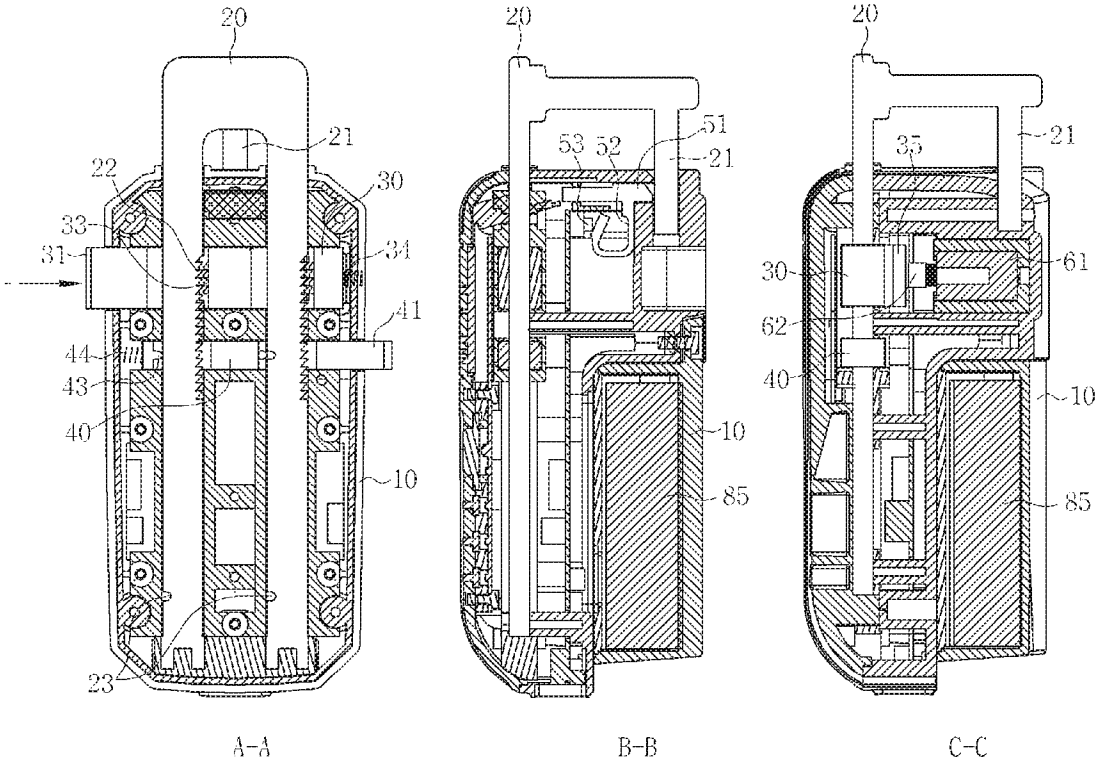

[Fig. 11]
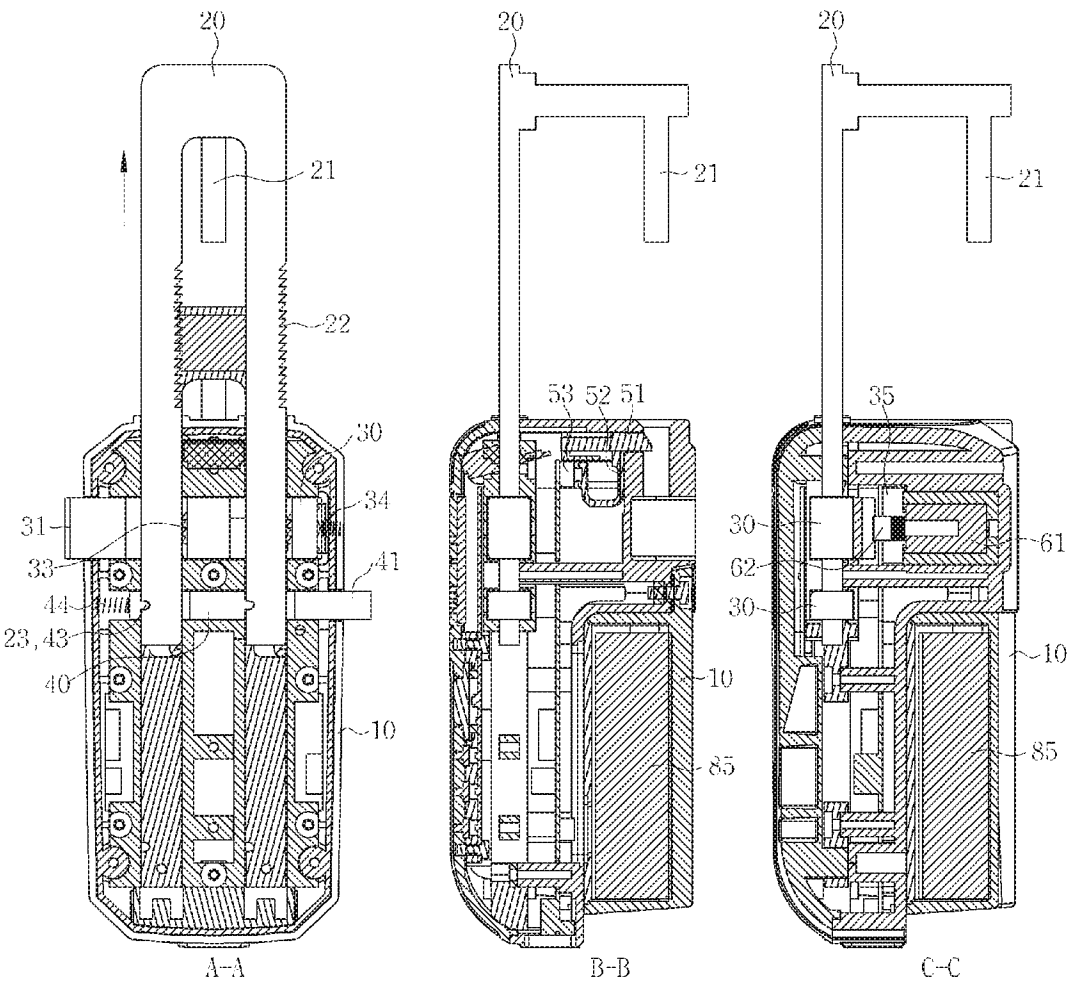

DEVICE FOR SEALING CONTAINER DOOR AND METHOD FOR OPERATING SAME

RELATED APPLICATIONS

This application is a National Phase of PCT Patent Application No. PCT/KR2013/008532 having International filing date of Sep. 24, 2013, which claim the benefit of priority of Korean Patent Application No. 10-2013-0109015 filed on Sep. 11, 2013. The contents of the above applications are all incorporated by reference as if fully set forth herein in their entirety.

FIELD AND BACKGROUND OF THE INVENTION

The present invention relates to a device for sealing a container door, and in particular to a device for sealing a container and a method for operating the same, which are configured for the sake of a container security in such a way that the device for sealing a container door is installed at a locking device of a container door so as to detect if the container door is forcibly opened or closed by an unauthorized person during a container transportation from a freight-loaded place to a freight-unloaded place, and a result of such a detection is wirelessly transmitted to a container security system.

The container is a box-shaped container used to efficiently and economically transport a predetermined freight. The container in general is called a freight container at the ISO (International Organization for Standardization) and is called a cargo container at the ANSI (American National Standards Institute).

The freight transportation using a container may take months in terms of a transportation period via multiple stages, for example, a freight loading, a transportation using a truck, a gate-in, a shipping, a sailing, a disembark, a gate-out, a transportation using a truck, a freight unloading, etc.

A mechanism for monitoring the safety of the container and its stuff is being considered a very important matter during a freight transportation procedure which is carried out using the container. In recent years, a wireless device is being employed, which is able to detect the opened or closed state of a container door so as to trace a corresponding container and recognize a sealed state and an inner state of the container, thus wirelessly transmitting a result of the detection to a server of the container security system.

For an example, the Korean patent registration number 1175173 describes a container security device wherein it is detachably attached to the opening and closing bars at both sides of a container, and an opened or closed state of the container is sensed, and a sensed opening and closing information is transmitted to a distant place, whereupon a sealed state of the container can be confirmed in real time, by means of which the container can be safely transported to a destination, and if the current position of the container during the transportation and the container deviate from a designated transportation route, the deviations thereof can be confirmed in real time.

Since the above-described container security device is designed to operate by only an electrical mechanism, an error may occur with a function for sensing a seal-release or a locking and unlocking operation of a sealing unit which may occur due to moisture or external impact.

SUMMARY OF THE INVENTION

Accordingly, the present invention is made in an effort to resolve the above-mentioned problems. It is an object of the present invention to provide a device for sealing a container door and an operation method for the same, which may allow to minimize any error with a sealing sensing and a locking and unlocking operation by minimizing any influence from moisture or external impact, and may allow to carry out a reliable sealing and security operation together with a simplified component configuration.

To achieve the above objects, there is provided a device for sealing a container door, which may include, but is not limited to, a main body on the upper end of which a guide hole and a locking hole are penetratingly formed; a locking member, which is installed on the main body so as to slide vertically along the guide hole, and which is provided on one end with a locking bar that is inserted into a mechanical seal hole on the container door by moving in and out of the locking hole; a fixing unit, which is installed inside the main body, for fixing the locking member when the locking bar on the locking member is inserted into the inside of the locking hole, and of which one end protrudes out of the main body so that the fixed state of the locking member can be released through an operation by a user; a seal-release authentication unit, which is installed on the main body, for wirelessly communicating with a near field communication module carried by an outside user; a holding unit, which is installed inside the main body so as to come into contact with or separate from a portion of the fixing unit by means of electrical energy, for fixing the fixing unit by coming into contact with the fixing unit so that a release operation of the fixing unit does not occur when the seal-release authentication is not carried out by the seal-release authentication unit, and for allowing a release operation of the fixing unit by separating from the fixing unit when the seal-release authentication is performed; a seal-sensing unit for sensing a locked and an open state of the locking member, according to the vertical movement of the locking member; and a telecommunication module for wirelessly communicating, to an external security control server, the locked or the open state sensed by the seal-sensing unit.

To achieve the above objects, there is provided a method for operating a device for sealing a container door, which may include, but is not limited to, a step (a) wherein a sealing is carried out in such a way that a locking bar of a locking member descends and is inserted inside a mechanical seal hole of the container door and a locking hole of a main body, and the locking member is fixed with respect to the main body; a step (b) wherein an operation where the sealing has been completed by the locking member is wirelessly communicated with an external security control server via a telecommunication module, and an authorization information of a near field communication module, wherein a seal-release authorization is available, is received from an external security control server; a step (c) wherein a sealing state of the container door is wirelessly communicated with the external security control server in real time via the telecommunication module during the transportation of the container; a step (d) wherein the authorization information is confirmed for the sake of a seal-release in such a way to carry out a near field wireless communication between the near field communication module that a user is carrying, and the seal-release authentication unit when the container has arrived at the destination; a step (e) wherein if the authorization information is confirmed, the fixed state of the fixing unit is removed by supplying electric power to a holding unit; a step (f) wherein the fixed state of the locking member is removed in such a way that the user operates the fixing unit; and a step (g) wherein the sealing is broken by ascending the locking member.

The present invention has an effect on enhancing a container security in such a way that a container door is easily sealed, and a sealing state is detected in real time, and a result of the detection is transmitted to a security control server.

The device for sealing a container door according to the present invention is able to minimize any influence due to water since water does not flow inside a locking hole as a drainage hole communicates with the locking hole of a main body and is able to prevent any error due to moisture and external impact in such a way that a seal-sensing unit is designed to operate based on a mechanical mechanism.

Since a main body can be removed from a container in such a way to break a locking member and separate the locking member from the main body without breaking the main body if an emergency situation occurs, whereupon if the locking member is damaged, only the damaged locking member can be changed, and the device of the present invention can be reused.

BRIEF DESCRIPTION OF THE SEVERAL VIEWS OF THE DRAWINGS

FIGS. 9, 10 and 11 are views wherein the cross section views in FIGS. 6 to 8 are illustrated together so as to continuously illustrate an operation state of a device for sealing a container door.

DESCRIPTION OF SPECIFIC EMBODIEMENTS OF THE INVENTION

The device for sealing a container door and a method for operating the same according to an embodiment of the present invention will be described with reference to the accompanying drawings.

Figure 1:
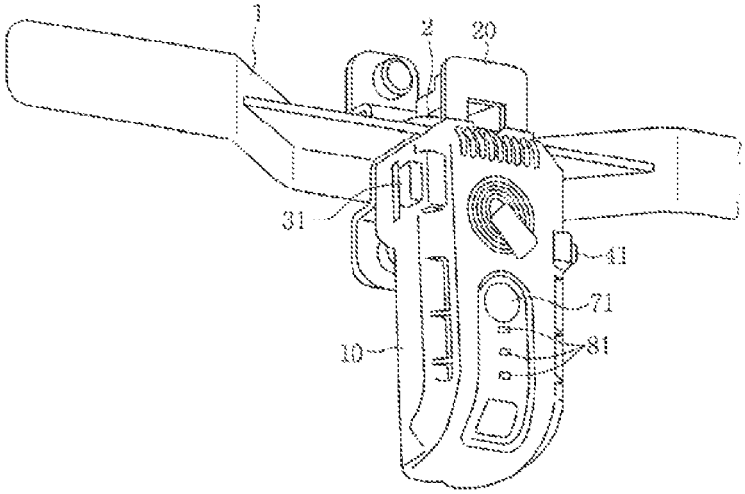
FIG. 1 is a perspective view illustrating a device for sealing a container door according to an embodiment of the present invention.
Figure 2:
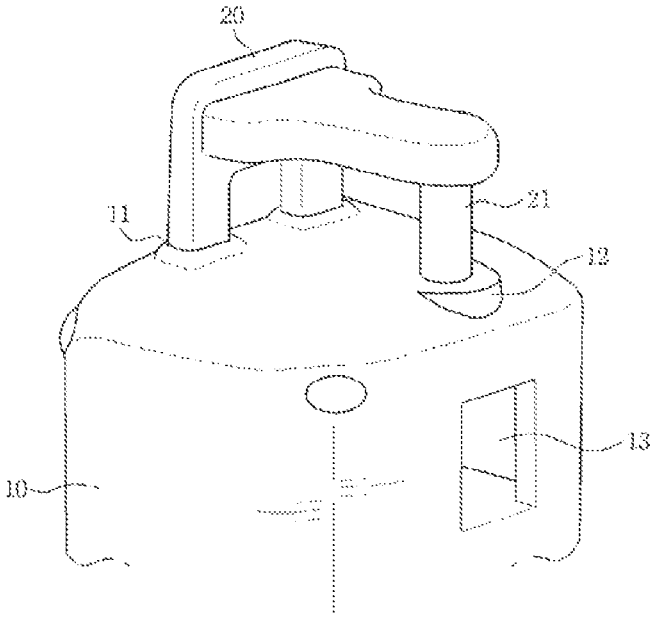
FIG. 2 is a partial perspective view illustrating a device for sealing a container door in FIG. 1 when it is viewed from the backside of the device.
Figure 3:
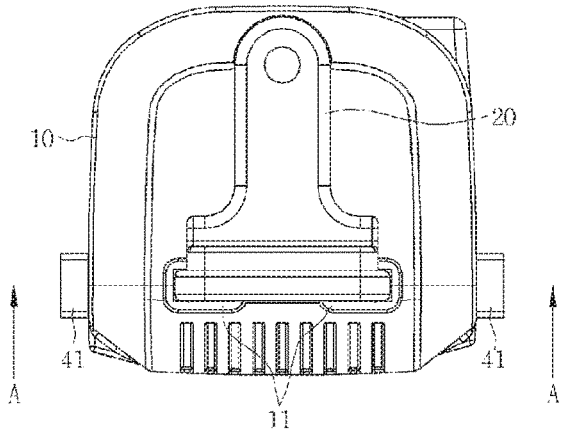
FIG. 3 is a plane view illustrating a device for sealing a container door in FIG. 1.
Figure 4:
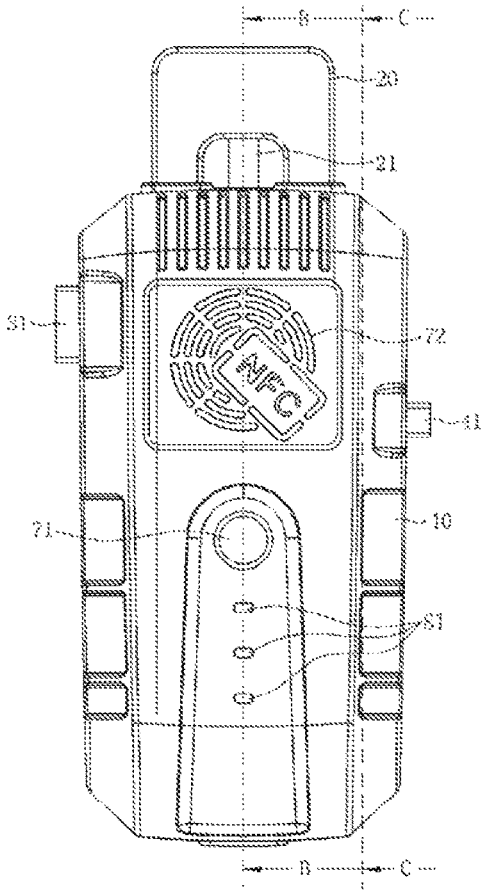
FIG. 4 is a front view illustrating a device for sealing a container door in FIG. 1.
Figure 5:
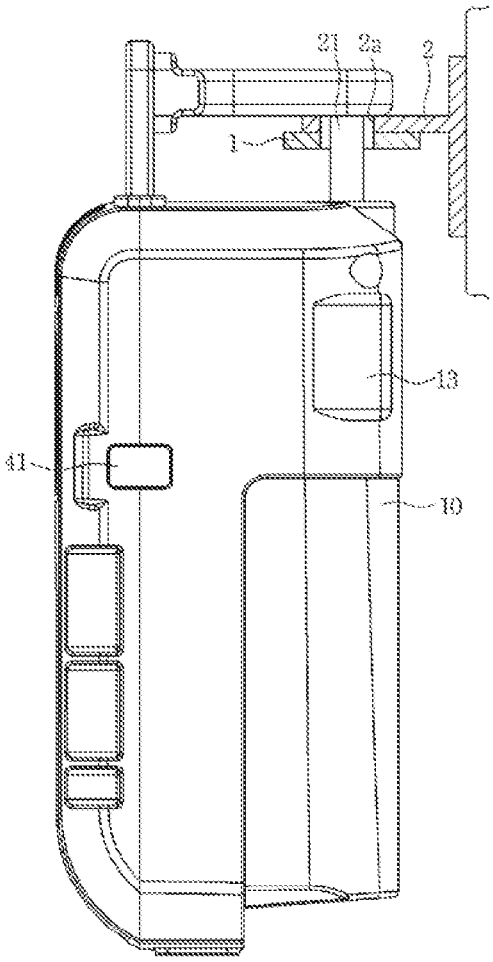
FIG. 5 is a side view illustrating a device for sealing a container door in FIG. 1.
Figure 6:
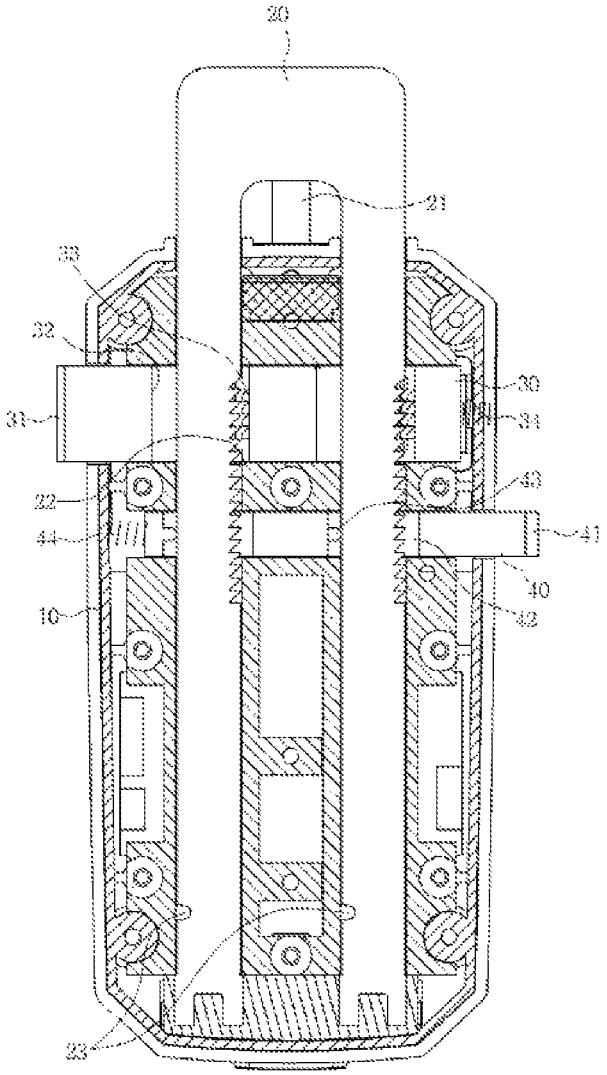
FIG. 6 is a cross sectional view taken along line A-A in FIG. 3.
Figure 7:
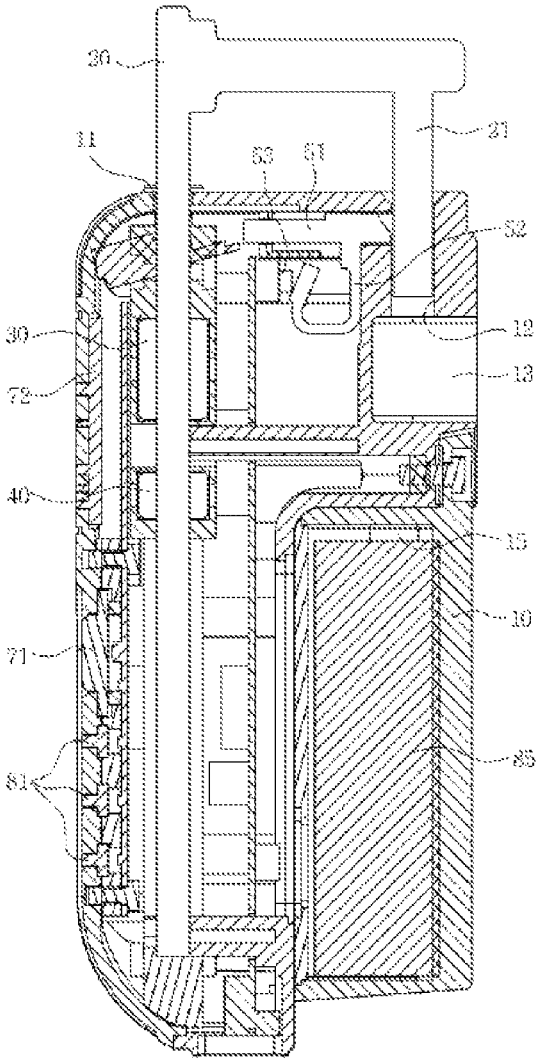
FIG. 7 is a cross sectional view taken along line B-B in FIG. 4.
Figure 8:
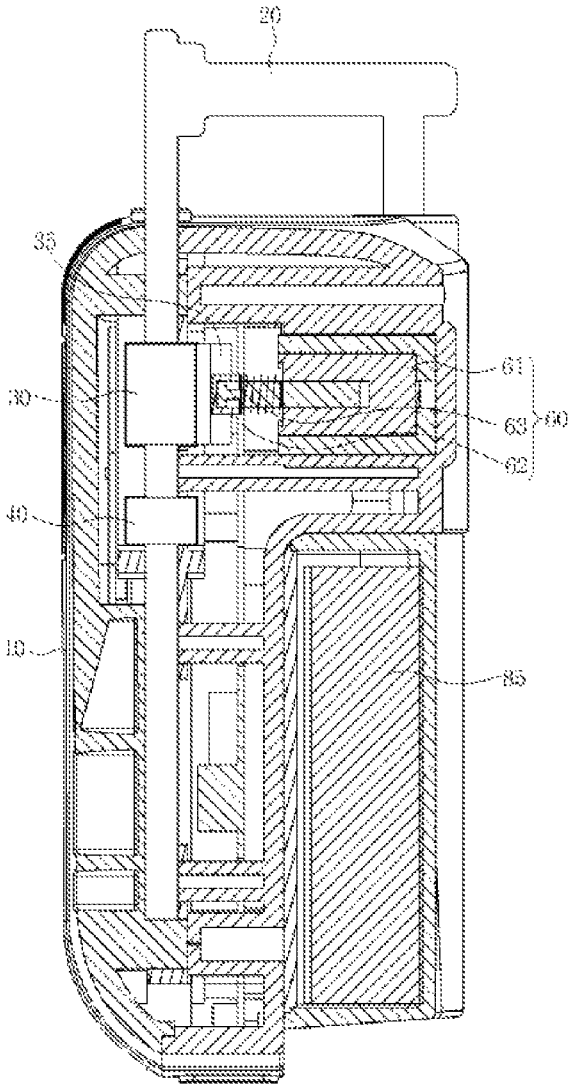
FIG. 8 is a cross sectional view taken along line C-C in FIG. 4.
Figure 9:
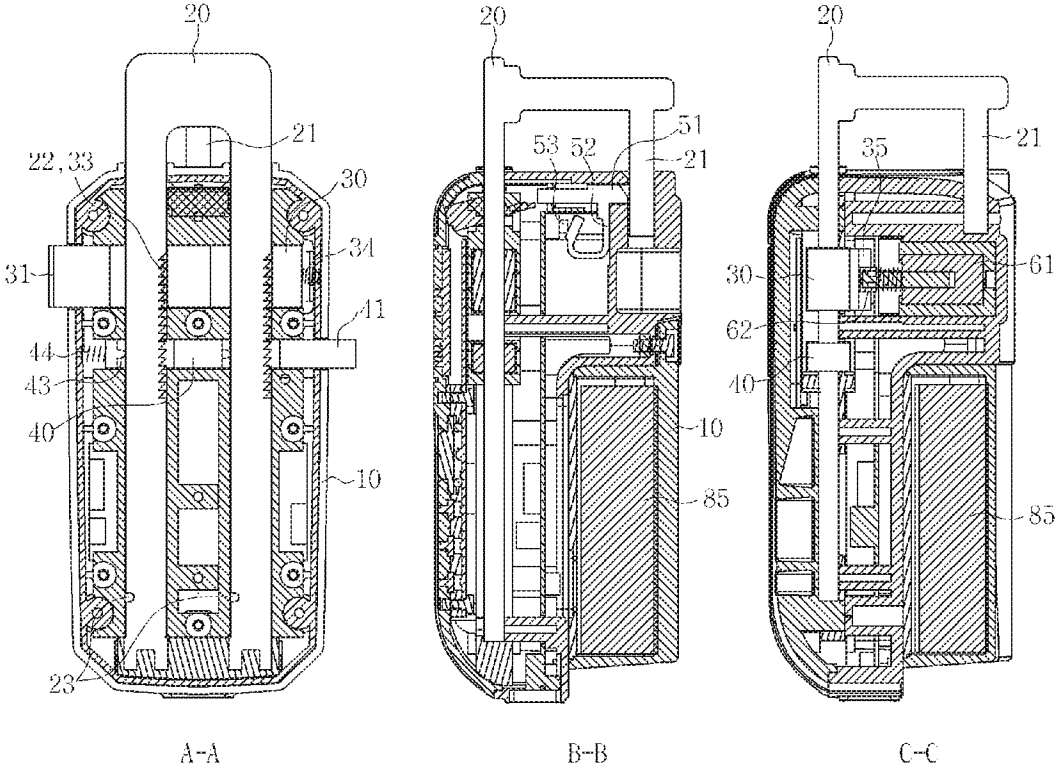

FIGS. 1 to 11 are views illustrating a device for sealing a container door according to an embodiment of the present invention. The device for sealing a container door according to the present invention may include, but is not limited to, a main body 10, a locking member 20, a fixing unit, a stopper unit, a seal-release authentication unit, a holding unit 60, a seal-sensing unit, a LED state display unit 81, a battery 85, and a control board.

The main body 10 is formed in a hollow cylindrical structure wherein a guide hole 11 and a locking hole 12 are formed, passing through an upper end portion of the main body 10, in order for the locking member 20 to move upward and backward in the guide hole 11 and the locking hole 12. A drainage hole 13 is formed at a rear portion of the main body 10, while passing and extending to the outside of the main body 10, in order for the water inputted inside the locking hole 12 not to gather inside the locking hole 12 as it communicates with a lower end portion of the locking hole 12. A battery engaging unit 15 at which the battery 85 is engaged, and a card engaging unit (not illustrated) at which a USIM (not illustrated) is engaged, are provided at a rear lower end portion of the main body 10.

The locking member 20 is formed in an inverted U-shaped bar structure. If the locking member 20 is formed in a structure wherein a left and right width is wide, it is advantageous to prevent any robbery since cutting the product is not easy. An upper end portion of the locking member 20 is formed bent at a right angle horizontal to the ground, and a locking bar 21 is formed a the end portion thereof, wherein the locking bar 21 is inserted in a sealing hole 2*a* of a mechanical seal 2*a* of the container door and comes out and goes in the locking hole 12 of the main body 10. The locking bar 21 has a roughly circular cross section and is formed extending downward by a predetermined length from an upper end portion of the locking member 20.

A coupling groove 22 is formed at an intermediate portion of the locking member 20 inserted inside the main body 10 for the sake of an engagement to the fixing unit. An engaging groove 23 is formed concave at a lower portion of the locking member 20 for the sake of an engagement to the stopper unit. The coupling groove 22 is formed in a ratchet tooth type, and various types of the grooves may be employed.

The fixing unit is installed inside the main body 10, and a sealing can be carried out since the fixing unit fixes the locking member 20 when the locking bar 21 of the locking member 20 is inserted inside the locking hole 12. When it needs to break the sealing, the fixed state may be removed in response to a user's pressing action. In this embodiment, the fixing unit may include, but is not limited to, a fixing bar 30 which is formed at an end portion thereof and equips with a seal-release button 31 protruding outward from a side surface of the main body and is configured in such a way that it can slide in a lateral direction in response to a user's pressing action, wherein two through holes 32 through which the locking member 20 pass, are passing through the fixing bar 30; a coupling protrusion 33 which is formed at an inner circumferential surface of the through hole 32 of the fixing bar 30 and is inserted inside the coupling groove 22 formed at an outer circumferential surface of the locking member 20, thus fixing the locking member 20; and a fixing bar spring 34 which is installed inside the main body 10 and is able to elastically support the fixing bar 30 with respect to the main body 10.

The fixing bar 30 is formed in a long bar shape which is extending in a lateral direction of the main body 10, and a holding groove 35 is formed at an end portion thereof, wherein a part of the holding unit 60 is inserted inside the holding groove 35.

The coupling protrusion 33 is formed in a ratchet tooth type which may correspond to the coupling groove 22. If the locking member 20 descends, the coupling protrusion 33 will natural descend without being hooked by the coupling groove 22, and if an upward movement force is applied to the locking member 20, the coupling protrusion 33 is hooked by the coupling groove 22, thus limiting the upward movement of the locking member 20.

The fixing bar spring 34 may be formed of a compression coil spring, and various types of springs can be employed.

The stopper unit is configured to fix the locking member 20 with respect to the main body 10 when the locking member 20 moves upward of the main body 10, and the locking bar 21 positions at a predetermined height of an outer portion of the locking hole 12. In this embodiment, the stopper unit may include, but is not limited to, a stopper bar 40 which includes at an end portion thereof a stop removing button 41 which is formed protruding outward from a side surface of the main body 10 and is configured in such a way that it slides in a lateral direction in response to a user's pressing action, wherein two through holes 42 through which the locking member 20 pass, are passing through the stopper bar 40 in upward and downward directions; a stopper protrusion 43 which is formed protruding from an inner circumferential surface of the through hole 42 of the stopper bar 40 and is able to support the locking member 20 when it inserts inside the engaging groove 23 formed at a lower portion of the locking member 20; and a stopper spring 44 which is installed inside the main body 10 and is able to elastically support the stopper bar 40 with respect to the main body 10.

The seal-release authentication unit will carry out a user authorization in such a way to wirelessly communicate with a near field communication module that an external user is carrying. The seal-release authentication unit may include an authorization start button 71 which is installed exposed to the outside at a front surface of the main body 10 and may allow to start an authorization work in response to a user's action; and a near field communication antenna 72 which may allow to carry out a wireless communication with the near field communication module that the user is carrying, when the sealing authorization work starts in response to an operation of the authorization start button 71. The near field communication module may be either a near field communication (NFC) module mounted at a portable mobile communication terminal or a NFC tag card. The near field communication antenna 72 may be formed of a NFC antenna. Except for the above components, a near field communication module, for example, a RFID or a Bluetooth, may be employed.

The holding unit 60 is configured to carry out the operations wherein if a sealing authorization is not carried out by the seal-release authentication unit, it will fix the fixing bar 30 so as to interrupt the breaking operation of the fixing bar 30 after contacting with the fixing bar 30 of the fixing unit, and if the seal-release authorization is carried out, it will become spaced apart from the fixing bar 30 and will allow a breaking operation of the fixing bar 30. In this embodiment, the holding unit 60 may include a solenoid 61 which is installed inside the main body 10, wherein a coil is wound around, to which electric power is applied in response to a seal-release authorization; a plunger 62 which is installed movable reciprocating by a predetermined distance with the aid of electromagnetic field formed by the solenoid 61 and is able to fix or unfix the fixing bar 30 as it is inserted inside or separates from the holding groove 35 of the fixing bar 30; and a plunger spring 63 which is able to elastically support the plunger 62 with respect to the solenoid 61.

The seal-sensing unit is configured to carry out an operation wherein the locking or unlocking state by the locking member 20 as the locking member 20 moves upward or downward can be automatically detected, whereby it is possible to automatically detect if the locked state is removed by forcibly breaking the locking member 20 from the outside. The seal-sensing unit may include, but is not limited to, a sensing bar 51 which is installed horizontally movable at the top of the main body 10, wherein an end portion thereof is formed protruding toward the inside of the locking groove 12, whereby the sensing bar 51 can horizontally slide contacting with an outer surface of the locking bar 21 when the locking bar 21 is inserted inside the locking hole 12; a sensor dog 52 which is installed extending downward at the sensing bar 51 and is configured to move together with the sensing bar 51; and a sensing switch 53 which is installed at a portion of the sensor dog 52 and is configured to contact with or separate from the sensor dog 52 in response to the movement of the sensor dog 52.

The sensor dog 52 is formed in a U-shape, and is able to turn on or off the sensing switch 53 while elastically contacting with the sensing switch 53. The sensing switch 53 may be formed of a tact switch.

Not illustrated in the drawings, on the control board are mounted a plurality of electronic components, for example, a telecommunication module (for example, a WCDMA communication interface) which is able to wirelessly communicate a locking or open state detected by the seal-sensing unit with an external container security control server, a near field communication module which is connected to the near field communication antenna 72, and a controller which is able to supply electric power to the LED state display unit 81 and the solenoid 61.

The main body 10 may further include a USB (Universal Serial Bus) port (not illustrated) to which a USB terminal can be connected to supply electric power to the battery 85 or connect an external device, for example, a computer, etc.

The device for sealing a container door according to the present invention may be configured to collect position information by using a GNSS (Global Navigation Satellite System) and transmit an accurate position information to the distant security server in the middle of the operation. If an illegal seal-release occurs during the transportation of the container, the device for sealing a container door according to the present invention will transmit an alarm information including a place information where the sealing has been broken, to an external security control server with the aid of a distant communication function.

Moreover, a non-contact type magnetic sensor (a reed sensor) may be further installed at the battery engaging unit 15 of the main body 10 wherein the battery 85 is mounted. The non-contact type magnetic sensor is able to detect if the battery 85 is randomly disassembled in the middle of the operation, in such a way to react with a magnetic substance provided at the battery 85, whereby any problem, for example, with the separation of the battery can be monitored in real time, and the problem can be reported to the external security control server.

The operation of the device for sealing a container door according to the present invention will be described below.

The method for operating a device for sealing a container door may include, but is not limited to, a step (a) wherein a sealing is carried out in such a way that a locking bar 21 of a locking member 20 descends and is inserted inside a mechanical seal hole **2*a* of the container door and a locking hole 12 of a main body 10, and the locking member 20 is fixed with respect to the main body 10**;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

The method for operating a device for sealing a container door according to the present invention, which is formed of the above-described steps, will be described below.

First, the locking member 20 moves upward of the main body 10, and a lower end portion of the locking bar 21 is injected outside of the locking hole 12. In this state, the sealing hole 1*a* formed at the handle 1 of the container door is matched with the sealing hole 2*a* of the mechanical seal 2 attached to an outer surface of the container door, and a lower end portion of the locking bar 21 is aligned with the upper portions of the sealing holes 1*a* and 2*a*.

Since the locking member 20 is being supported by the stopper bar 40 since the stopper protrusion 43 of the stopper bar 40 has been inserted in the engaging groove 23 of the locking member 20, the locking member 20 may stay stably supported, not falling (refer to FIG. 11).

In this state, if the user presses the stop removing button 41 formed at an end portion of the stopper bar 40, the stopper protrusion 43 of the stopper bar 40 will separate from the inside of the engaging groove 23 of the locking member 20, and the locking member 20 will become free, and then the locking member 20 will fall. So, the locking bar 21 of the locking member 20 will insert inside the locking hole 12 formed at the top of the main body 10 via the sealing hole 2*a* of the mechanical seal 2.

If the user presses downward the locking member 20, and the locking bar 21 is inserted complete inside the locking hole 12, the locking bar 21 will be inserted complete inside the locking hole while pushing the end of the sensing bar 51 of the seal-sensing unit which has been protruding inward of the locking hole 12.

Since the locking bar 21 is inserted inside the locking hole 12, and the sensing bar 51 slides inside the main body 10, the sensor dog 52 will elastically pressurize the sensing switch 53 and will turn on the sensing switch 53. If the sensing switch 53 is turned on, the control board will recognize that the locking member 20 has been in the locked state and will transmit an information thereon to the security control server via the telecommunication module. Moreover, the controller will receive an authorization information of the near field communication module, which is able to authorize the sealing authorization, from the external security control server via the telecommunication module.

If the locking member 20 descends, and the locking bar 21 is inserted complete inside the locking hole 12, the coupling groove 22 of the locking member 20 will engage with the coupling protrusion 33 of the fixing bar 30, by means of which the upward movement of the locking member 20 is limited, so the locking member 20 is fixed with respect to the main body 10. Here, the plunger 62 of the holding unit 60 will be elastically inserted inside the holding groove 35 of the fixing bar 30, whereupon the lateral direction movement of the fixing bar 30 is limited (refer to FIG. 9).

If the locking member 20 is locked inside the main body 10, and the sealing of the container door is completed, the container will be transported.

While the container is being transported, the controller of the control board will transmit in real time a sealing state detected by the seal-sensing unit, to the container security control server with the aid of the telecommunication module. In the middle of the transportation of the container, if the locking member 20 is forcibly broken by a non-authorized person, and the locking bar 21 separates from the inside of the locking hole 12, and the locked state is removed, the sensing bar 51 of the seal-sensing unit will horizontally move in the outward direction of the main body 10, which is an opposite direction as compared to the previous operation, so the contact between the sensor dog 52 and the sensing switch 53 is removed, whereupon the controller will recognize that the sealed state has been broken and will report to the container control server.

Meanwhile, when the container arrives at the destination, and a user having an authorization information wants to break the sealed state, the user will press the authorization start button 71 and approach a portable mobile communication terminal, for example, a smart phone, etc. which is containing the authorization information, or an authorization card toward the main body 10, a near field communication is made via the near field communication antenna 72, and the authorization information will be transferred to the controller.

If the user authorization information is confirmed using the near field communication, the controller will pull the plunger in such a way to supply electric power to the solenoid 61. If the plunger 62 is pulled and separates toward the outside of the holding groove 35 of the fixing bar 30, the fixing bar 30 will become free, so it can move in a lateral direction.

In this state, if the user presses the seal-release button 31 of the fixing bar 30 which is protruding outward of the main body 10, the fixing bar 30 will move in the lateral direction, and the coupling protrusion 33 of the fixing bar 30 and the coupling groove 22 of the locking member 20 will be spaced apart from each other, whereby the fixed state of the locking member 20 can be removed (refer to FIG. 10).

If the user moves upward the locking member 20 with one hand, with the other hand holding the main body 10, the locking bar 21 comes out of the locking hole 12, whereby the sealed state is broken (refer to FIG. 11). The controller will report to the security control server using the telecommunication module that the sealing of the container has been normally broken.

The device for sealing a container door according to the present invention is made in a simplified configuration, which makes it possible to easily seal the container door, and the sealing state is accurately detected, and a result of the detection is transmitted in real time to the security control server, by means of which the security of the container can be enhanced.

In case of an emergency situation, the main body 10 can be removed from the container in such a way to separate the locking member 20 from the main body 20 after the locking member 20 has been broken, without breaking the main body 10, and even when the locking member 20 is broken, only the broken locking member 20 can be changed, and the product can be reused.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

INDUSTRIAL APPLICABILITY

The present invention can be applied to a sealing device or a locking device which is able to detect the opening or closing of a container door.

What is claimed is:

1. A device for sealing a container door, comprising:

a main body 10 on the upper end of which a guide hole 11 and a locking hole 12 are penetratingly formed;

a locking member 20 which is installed on the main body 10 so as to slide vertically along the guide hole 11, and which is provided on one end with a locking bar 21 that is inserted into a mechanical seal hole 2*a* on the container door by moving in and out of the locking hole 12;

a fixing unit which is installed inside the main body 10, for fixing the locking member 20 when the locking bar 21 on the locking member 20 is inserted into the inside of the locking hole 12, and of which one end protrudes out of the main body 10 so that the fixed state of the locking member 20 can be released through an operation by a user;

a seal-release authentication unit which is installed on the main body 10, for wirelessly communicating with a near field communication module carried by an outside user;

a holding unit 60 which is installed inside the main body 10 so as to come into contact with or separate from a portion of the fixing unit by means of electrical energy, for fixing the fixing unit by coming into contact with the fixing unit so that a release operation of the fixing unit does not occur when the seal-release authentication is not carried out by the seal-release authentication unit, and for allowing a release operation of the fixing unit by separating from the fixing unit when the seal-release authentication is performed;

a seal-sensing unit for sensing a locked and an open state of the locking member 20, according to the vertical movement of the locking member 20; and a telecommunication module for wirelessly communicating, to an external security control server, the locked or the open state sensed by the seal-sensing unit;

a stopper unit which is able to fix the locking member 20 with respect to the main body 10 if the locking member 20 moves upward of the main body 10, and the locking bar 21 positions at a predetermined height of an outer portion of the locking hole 12;

wherein the stopper unit comprises:

a stopper bar 40 which includes at an end portion thereof a stop removing button 41 which is formed protruding outward of one side surface of the main body 10, and is configured to slide in a lateral direction in response to a user's pressing action, wherein the stopper bar 40 includes a through hole 42 through which the locking member 20 passes, a stopper protrusion 43 which is formed protruding from an inner circumferential surface of the through hole 42 of the stopper bar 40 and is able to support the locking member 20 as it is inserted inside an engaging groove 23 formed concave at the locking member 20, and a stopper spring 44 which is installed inside the main body 10 and is able to elastically support the stopper bar 40 with respect to the main body 10.

2. The device of claim 1, wherein the fixing unit comprises:

a fixing bar 30 which includes at an end portion thereof a seal-release button 31 which is formed protruding outward of one side surface of the main body 10, and is configured to slide in a lateral direction in response to a user's pressing action, wherein the fixing bar 30 includes a through hole 32 through which the locking member 20 passes;

a coupling protrusion 33 which is formed at an inner circumferential surface of the through hole 32 of the fixing bar 30 and is able to fix the locking member 20 as it is inserted inside a coupling groove 22 formed at an outer circumferential surface of the locking member 20; and a fixing bar spring 34 which is installed inside the main body 10 and is able to elastically support the fixing bar 30 with respect to the main body 10.

3. The device of claim 2, wherein the coupling groove 22 and the coupling protrusion 33 are formed in ratchet tooth shapes.

4. The device of claim 1, wherein the holding unit 60 comprises:

a solenoid 61 which is installed inside the main body 10 and around which a coil is wound, wherein electric power is supplied thereto in response to a seal-release authorization;

a plunger 62 which is installed in such a way to reciprocate by a predetermined distance with the aid of electromagnetic field generated by the solenoid 61 and is configured to contact with or separate from the fixing unit, thus fixing or unfixing the fixing unit; and a plunger spring 63 which is able to elastically support the plunger 62 with respect to the solenoid 61.

5. The device of claim 1, wherein the seal-sensing unit comprises:

a sensing bar 51 which is installed horizontally movable at the top of the main body 10, wherein an end portion thereof is formed protruding inward of the locking hole 12, and when the locking bar 21 is inserted inside the locking hole 12, the sensing bar 51 contacts with an outer surface of the locking bar 21 and slides in a horizontal direction;

a sensor dog 52 which is installed extending downward at the sensing bar 51 and is configured to move together with the sensing bar 51; and a sensing switch 53 which is installed at a portion of the sensor dog 52 and contacts with or separates from the sensor dog 52 in response to the movement of the sensor dog 52.

6. The device of claim 5, wherein the sensor dog 52 is formed in a U-shape and is configured to elastically contact with the sensing switch 53.

7. The device of claim 1, wherein the seal-release authentication unit comprises:

an authorization start button 71 which is installed exposed to the outside at the main body 10 and is configured to start a sealing authorization work in response to a user's operation; and a near field communication antenna 72 which is able to wirelessly communicate with a near field communication module that a user is carrying, when a sealing authorization work starts in response to an operation of the authorization start button 71.

8. The device of claim 7, wherein the near field communication module that the user is carrying is either a near field communication (NFC) module mounted at a portable mobile communication terminal or a NFC tag, and the near field communication antenna 72 is a NFC antenna.

9. The device of claim 1, wherein a lower end portion of the locking hole 12 of the main body 10 is formed communicating with a drainage hole 13 formed passing through outward of the main body 10.

10. The device of claim 1, wherein the locking member 20 is formed in an inverted U-shaped bar type.

11. The device of claim 1, further comprising:

a battery 85 which is mounted at the main body 10 and is able to supply electric power; and a non-contact type reed sensor which is installed near the battery 85 and inside the main body 10 and is able to react in response to a magnetic substance provided at the battery 85 and detect if the battery 85 is randomly disassembled in the middle of operation.

12. A method for operating a device for sealing a container door of claim 1, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

13. A method for operating a device for sealing a container door of claim 1, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

14. A method for operating a device for sealing a container door of claim 1, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

15. A method for operating a device for sealing a container door of claim 2, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

16. A method for operating a device for sealing a container door of claim 3, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

17. A method for operating a device for sealing a container door of claim 4, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

18. A method for operating a device for sealing a container door of claim 5, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

19. A method for operating a device for sealing a container door of claim 6, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

20. A method for operating a device for sealing a container door of claim 7, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

21. A method for operating a device for sealing a container door of claim 8, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

22. A method for operating a device for sealing a container door of claim 9, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

23. A method for operating a device for sealing a container door of claim 10, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

24. A method for operating a device for sealing a container door of claim 11, comprising:

a step (a) wherein a sealing is carried out in such a way that a locking bar 21 of a locking member 20 descends and is inserted inside a mechanical seal hole 2*a* of the container door and a locking hole 12 of a main body 10, and the locking member 20 is fixed with respect to the main body 10;

a step (b) wherein an operation where the sealing has been completed by the locking member 20 is wirelessly communicated with an external security control server via a telecommunication module, and an authorization information of a near field communication module, wherein a seal-release authorization is available, is received from an external security control server;

a step (c) wherein a sealing state of the container door is wirelessly communicated with the external security control server in real time via the telecommunication module during the transportation of the container;

a step (d) wherein the authorization information is confirmed for the sake of a seal-release in such a way to carry out a near field wireless communication between the near field communication module that a user is carrying, and the seal-release authentication unit when the container has arrived at the destination;

a step (e) wherein if the authorization information is confirmed, the fixed state of the fixing unit is removed by supplying electric power to a holding unit 60;

a step (f) wherein the fixed state of the locking member 20 is removed in such a way that the user operates the fixing unit; and a step (g) wherein the sealing is broken by ascending the locking member 20.

* * * * *